US011684163B2

(12) United States Patent
Hille

(10) Patent No.: US 11,684,163 B2
(45) Date of Patent: Jun. 27, 2023

(54) ELECTROMOTIVE FURNITURE DRIVE, AND ITEM OF FUNCTIONAL FURNITURE HAVING AN ELECTROMOTIVE FURNITURE DRIVE

(71) Applicant: DEWERTOKIN GMBH, Kirchlengern (DE)

(72) Inventor: Armin Hille, Bielefeld (DE)

(73) Assignee: DewertOkin Technology Group Co., Ltd, Jiaxing (CN)

( * ) Notice: Subject to any disclaimer, the term of this patent is extended or adjusted under 35 U.S.C. 154(b) by 343 days.

(21) Appl. No.: 15/506,569

(22) PCT Filed: Aug. 27, 2015

(86) PCT No.: PCT/EP2015/069631
§ 371 (c)(1),
(2) Date: Feb. 24, 2017

(87) PCT Pub. No.: WO2016/030458
PCT Pub. Date: Mar. 3, 2016

(65) Prior Publication Data

US 2017/0311728 A1 Nov. 2, 2017

(30) Foreign Application Priority Data

Aug. 27, 2014 (DE) ..... 20 2014 104 011.0

(51) Int. Cl.
*A47C 20/04* (2006.01)
*A61G 7/018* (2006.01)
(Continued)

(52) U.S. Cl.
CPC ..... *A47C 20/041* (2013.01); *A47C 31/008* (2013.01); *A61G 7/015* (2013.01); *A61G 7/018* (2013.01); *A61G 2203/12* (2013.01)

(58) Field of Classification Search
CPC ..... A61B 5/002; A61B 5/6892; A61B 5/6887; A61B 5/6891; A61B 5/1115;
(Continued)

(56) References Cited

U.S. PATENT DOCUMENTS 4,351,016 A * 9/1982 Felbinger ..... E05F 15/46 318/266
4,407,030 A * 10/1983 Elliott ..... A61G 7/015 5/424
(Continued)

FOREIGN PATENT DOCUMENTS

DE 93 00 438 U1 3/1993
DE 297 07 795 U1 10/1998
JP 2014 064883 A 4/2014

OTHER PUBLICATIONS

English international Search Report issued by the European Patent Office in international Application PCT/EP2015/067280.

*Primary Examiner* — David R Hare
(74) *Attorney, Agent, or Firm* — Henry M. Feiereisen LLC

(57) ABSTRACT

The invention relates to an electromotive furniture drive for adjusting movable furniture parts (5, 6) of an item of functional furniture (1), having a control device (9), at least one adjusting drive (7, 8) with an electric motor, and at least one evaluation circuit (10) with an input (11, 12), which evaluation circuit can be electrically conductively connected to a sensor, which is attached to the item of functional furniture (1), and forms a proximity and/or contact detector together with said sensor. The electromotive furniture drive is distinguished in that at least two proximity and/or contact detectors are formed by in each case one sensor or a group of sensors together with the at least one evaluation circuit (10), it being possible for said proximity and/or contact detectors to be assigned to different moving furniture parts
(Continued)

(5, 6) of the item of functional furniture (1). The invention further relates to an item of functional furniture (1) having at least two groups of movable furniture parts (5, 6) and an electromotive furniture drive of this kind.

4 Claims, 2 Drawing Sheets

(51) Int. Cl.
*A47C 31/00* (2006.01)
*A61G 7/015* (2006.01)

(58) Field of Classification Search
CPC ... A61B 5/1114; A61B 5/1113; A47C 31/008; A47C 20/041; A47C 20/08; A61G 7/018; A61G 7/015; A61G 7/012; A61G 2203/12
See application file for complete search history.

(56) References Cited

U.S. PATENT DOCUMENTS 4,944,056 A * 7/1990 Schroeder ..... A61G 7/1015 5/85.1
4,977,480 A * 12/1990 Nishihara ..... G01L 9/0072 361/283.4
5,161,274 A * 11/1992 Hayes ..... A47C 20/041 5/616
5,235,258 A * 8/1993 Schuerch ..... A61G 7/018 318/16
5,235,319 A * 8/1993 Hill ..... G08B 21/22 307/125
5,571,973 A * 11/1996 Taylot ..... G01L 1/205 73/DIG. 4
5,796,355 A * 8/1998 Smigelski ..... H03K 17/962 200/600
6,201,481 B1 * 3/2001 Bellingroth ..... A47C 20/041 340/680
7,692,396 B2 * 4/2010 Ctvrtnicek ..... A47B 88/457 318/554
8,413,278 B2 * 4/2013 Chaffee ..... G05D 16/208 141/95
8,909,378 B2 * 12/2014 Rawls-Meehan ..... G08C 17/02 700/83
8,981,679 B2 3/2015 Hille
9,230,764 B2 1/2016 Hille
9,236,822 B2 1/2016 Hille et al.
9,252,692 B2 2/2016 Hille
9,331,610 B2 5/2016 Hille
9,478,122 B2 10/2016 Hille
9,836,034 B2 * 12/2017 Hille ..... A47C 20/041
10,376,075 B2 * 8/2019 Viermann ..... A47C 20/041
11,374,516 B2 * 6/2022 Hille ..... H02P 7/0094
11,419,554 B2 * 8/2022 Gehrke ..... A61B 5/1135
2003/0011225 A1 * 1/2003 Barcesat ..... A47C 20/041 297/217.3
2007/0163045 A1 * 7/2007 Becker ..... A61B 5/1115 5/616
2008/0255734 A1 * 10/2008 Altshuller ..... B60N 2/0244 297/217.3
2009/0237264 A1 * 9/2009 Bobey ..... A61G 7/05776 340/815.69
2011/0209287 A1 * 9/2011 Call ..... A61B 5/6887 5/658
2013/0174343 A1 * 7/2013 Chacon ..... G01B 7/003 5/613
2013/0247302 A1 * 9/2013 Chacon ..... G01V 3/088 5/613
2014/0094997 A1 * 4/2014 Hyde ..... G05D 1/0246 701/2
2014/0310875 A1 * 10/2014 Iida ..... A61G 1/01 5/606
2014/0331412 A1 * 11/2014 Taylor ..... G01L 1/18 5/691
2015/0019020 A1 1/2015 Hille et al.
2015/0025688 A1 1/2015 Hille et al.
2015/0026890 A1 1/2015 Hille et al.
2015/0035457 A1 2/2015 Hille et al.
2015/0048763 A1 2/2015 Hille
2015/0123772 A1 5/2015 Hille
2015/0241857 A1 8/2015 Hille

* cited by examiner

ELECTROMOTIVE FURNITURE DRIVE, AND ITEM OF FUNCTIONAL FURNITURE HAVING AN ELECTROMOTIVE FURNITURE DRIVE

CROSS-REFERENCES TO RELATED APPLICATIONS

This application is the U.S. National Stage of International Application No. PCT/EP2015/069631, filed Aug. 27, 2015, which designated the United States and has been published as International Publication No. WO 2016/030458 and which claims the priority of German Patent Application, Serial No. 20 2014 104 011.0, filed Aug. 27, 2014, pursuant to 35 U.S.C. 119(a)-(d).

BACKGROUND OF THE INVENTION

The invention relates to an electromotive furniture drive for adjusting movable furniture parts of an item of functional furniture, having a control unit, at least one adjustment drive having an electric motor, and at least one analysis circuit having an input, which is connectable in an electrically conductive manner together with a sensor attached to the item of functional furniture, and forms a proximity and/or touch detector. The invention additionally relates to an item of functional furniture having such an electromotive furniture drive.

Such electromotive furniture drives are known and comprise, for example, a number of adjustment drives, for example, linear drives. A linear drive generates a linear movement at an output element and has at least one electric motor, a gear train, and the output element, wherein the gear train having the output element is connected downstream of the electric motor. The linear drive and its output element are connected to furniture components and move or adjust them in relation to one another during operation of the motors. The furniture components are, for example, movably connected to a base frame and/or to one another by so-called functional or movement fittings. These fittings are typically made of metallic materials, for example, steel.

An item of functional furniture is provided with at least one electromotive furniture drive. Such an electromotive furniture drive is attached in the item of furniture, which has fixed and movable furniture components. Fixed furniture components are, for example, frame components. Movable furniture components are, for example, fixed or springy-yielding support surfaces of a cushion or a mattress of the item of seating and/or recumbent furniture and also sections or elements of the item of furniture which are adjustable manually or in an electromotive manner.

The electromotive furniture drive is used for adjusting the movable furniture components. In this case, the adjustment movement and drive force generated by the electromotive furniture drive are transmitted to the respective movable furniture component, wherein the electromotive furniture drive is supported on a fixed furniture component and adjusts the movable furniture component in relation to the fixed furniture component. The electromotive furniture drive can also be attached between two movable furniture components, wherein it can adjust them in relation to one another.

Electromotive furniture drives are known from the prior art in a variety of different embodiments for different usage cases and purposes, for example, as single drives, double drives, and multiple drives.

Control units are also known, which are designed for the purpose of activating the respective electric motor of an adjustment drive on command or as a consequence of an event, for example, a control command of a manual control, a limit switch, a detector, etc. The control units have inputs and outputs. The outputs are connected in an electrically conductive manner to the respective electric motor, for example. The inputs are connected in an electrically conductive manner, for example, to handheld remote controls or, possibly via analysis circuits, to sensors and detectors. Other control units have other outputs, which exclusively conduct an electrical or an electromechanical signal to a further control unit, which has the above-described outputs for operation of the respective electric motor.

SUMMARY OF THE INVENTION

In particular the control units described at the outset have proven themselves. A control unit having an input is known from document DE 297 07 795 U1, wherein the input is connected in an electrically conductive manner to a metallic functional fitting, for example, via a connecting line. The functional fitting or parts of the functional fitting forms/form, as a sensor, a detector together with an analysis circuit of the control unit and the connecting line. Via said connecting line, the analysis circuit of the control unit ascertains the level of the electric capacitance of the functional fitting in relation to a reference variable, for example, the floor. Furthermore, the control unit establishes the time change of the measured variable of the electrical capacitance, which is sensed by the analysis circuit. Rapid changes of the electrical capacitance of the functional fitting during the operation of the motor indicate a disturbance, for example, the occurrence of an arising or imminent pinching of an object or a body part, if a person or an object is moving in a hazardous region of the functional fitting or touches it. The respective motor is then turned off and optionally reversed for a short time.

The term "functional fitting" is to be understood to also include metallic frames and parts, for example, feet, of an item of functional furniture in this case. The term "sensor" means an element of a functional fitting or a separate, electrically conductive element here, for example, a cable, rod antenna, flat bar, etc., which is attached to the item of furniture.

The control unit mentioned at the outset has proven itself well. One disadvantage, however, exists in the case of large items of furniture, such as wide beds, or in the case of complex items of furniture, as in the case of an allocation of the functional fittings into multiple groups.

Multiple groups can be formed if, in a bed, for example, an upper frame is connected via electrically insulating rollers or slides to a lower frame. A further group can be formed if a footrest fitting section of a functional fitting of an armchair is arranged in a manner which is electrically insulated from the base frame using plastic bearings. Other groups can be formed if the item of furniture has multiple functional fittings which are each used for subregions of the item of furniture.

To provide a pinch protector for all movable furniture parts, according to the prior art, all movable parts or all sections of all functional fittings of the item of furniture have to be electrically connected to one another via flexible lines. This method has also proven itself, but the complexity of the control unit is very high, which is reflected in the high quality and in the installation effort of the electrical measuring circuit. Furthermore, it has been shown that a complex calibration of the system is necessary to prevent incorrect triggering of the pinch protector.

The invention is based on the object of providing an electromotive furniture drive having a control unit of the type mentioned at the outset, wherein the described disadvantages no longer occur or are significantly reduced, and which is additionally easy to install and is designed as easy to handle.

The achievement of the stated object is performed by an arrangement of more than one proximity and/or touch detector on an item of functional furniture. In this case, one sensor or one group of sensors forms such a detector with an analysis circuit in each case, wherein each sensor or each group of sensors is connected to one input of the analysis circuit. In this case, according to the invention, the item of furniture has a plurality of detectors, which are individually connected in an electrically conductive manner to an input of the analysis circuit of the control unit.

The design of the various detectors also enables a large functional fitting, for example, in the case of the illustrated bed as the functional furniture, to be reliably monitored without it having to be ensured that furniture parts to be monitored are galvanically connected to one another or that a sufficient capacitive coupling of the furniture parts with one another is provided. The allocation of all of the movable furniture parts to be monitored in an item of functional furniture into at least two groups, which are associated with various detectors, additionally prevents an undesired incorrect response due to interfering radiation, which can otherwise more easily be coupled into a large sensor area under certain circumstances.

A control unit is preferably provided with an analysis circuit, which has a plurality of inputs. In this case, each input is coupled to one sensor or one group of sensors. Furthermore, the analysis circuit preferably has a multiplexer in this case, via which the at least two inputs are sequentially connectable to a detector circuit of the analysis circuit. Due to this measure of classification into multiple groups in conjunction with a sequential analysis using only one detector circuit, the cost-effective production and easy installation of a high-sensitivity pinch protector is possible with high operational reliability at the same time.

Alternatively, multiple control units are provided, wherein an analysis circuit is associated with each control unit and each analysis circuit is coupled to at least one sensor.

In one advantageous embodiment of the electromotive furniture drive, the sensor or the group of sensors is/are conductively connected to one of the inputs of the at least one analysis circuit. Alternatively, the sensor or the group of sensors is/are capacitively coupled to one of the inputs of the at least one analysis circuit.

In a further advantageous embodiment of the electromotive furniture drive, the sensor is a sensor line and/or a conductive movable furniture part and/or a conductive element of a functional fitting.

An item of functional furniture according to the invention has at least two groups of movable furniture parts and at least one electromotive furniture drive according to any one of the preceding claims. The advantages mentioned above in conjunction with the furniture drive result.

BRIEF DESCRIPTION OF THE DRAWING

The invention will be explained in greater detail hereafter on the basis of an exemplary embodiment with the aid of figures. In the figures.

DETAILED DESCRIPTION OF PREFERRED EMBODIMENTS

Figure 1:
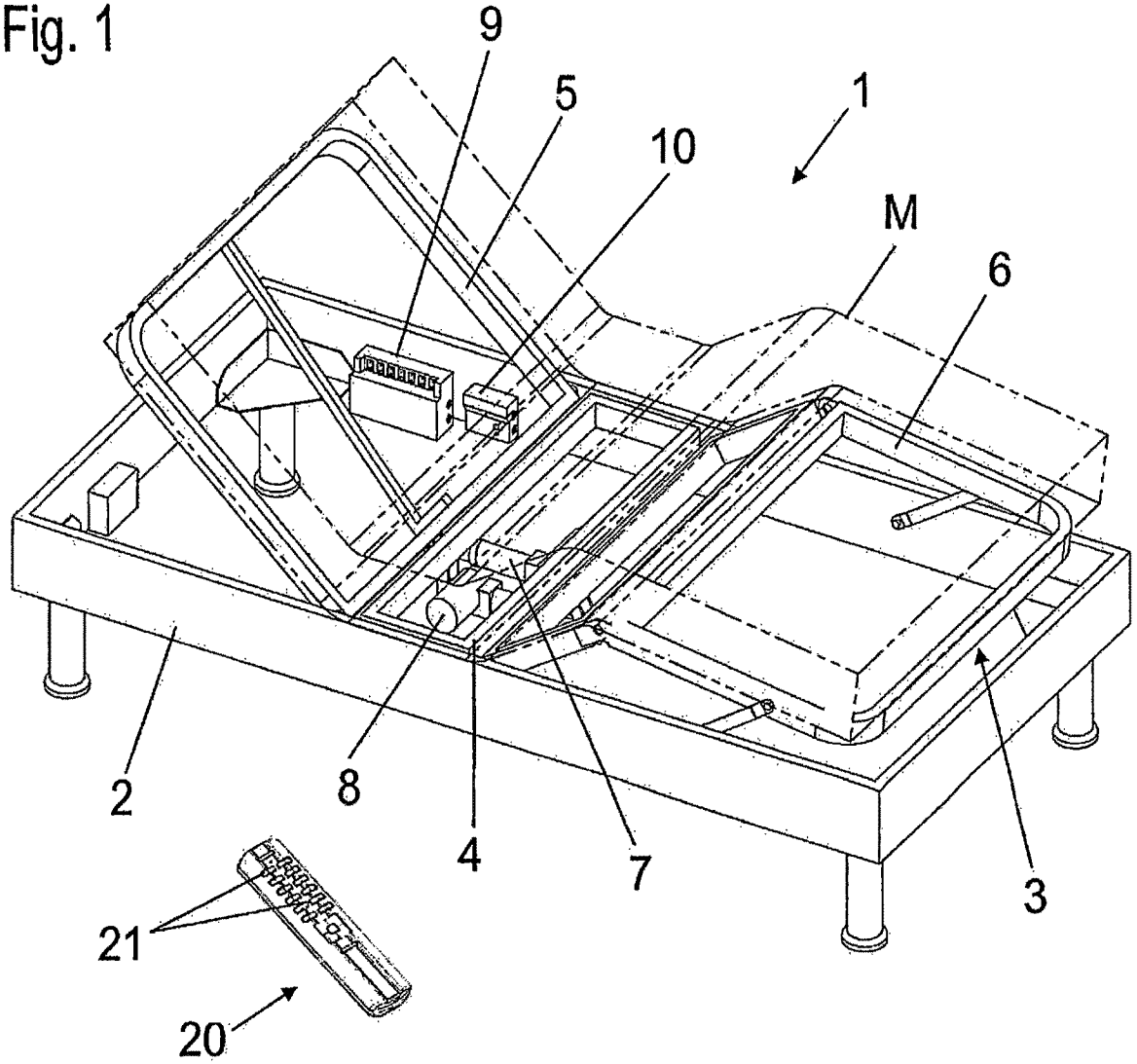
FIG. 1 shows a schematic perspective view of an exemplary furniture arrangement.

FIG. 1 shows an exemplary furniture arrangement having an item of functional furniture 1. A bed is shown by way of example as the item of functional furniture 1 here. The item of functional furniture 1 has a base element 2, a frame-type framework having feet here. A slatted frame having a functional fitting 3 is inserted into the base element 2. The slatted frame supports a mattress M.

In the illustrated example, the item of functional furniture 1 has two movable furniture parts 5 and 6, which are movable in relation to a fixed base part 4 arranged between them. Specifically, the two movable furniture parts 5, 6 are a back part and a leg part. They are also referred to as back part 5 and leg part 6 hereafter for simpler description.

The movable arrangement of the movable furniture parts 5 and 6 is implemented by the functional fitting 3, also called a movement fitting. The movement is designed as displaceable and/or pivotable.

The movably mounted back part 5 and the leg part 6 are each coupled to an electromotive adjustment drive 7, 8. Thus, the back part 5 is coupled to the electromotive adjustment drive 7. The electromotive adjustment drive 8 is provided for moving or adjusting the leg part 6.

The electromotive adjustment drives 7, 8 are designed here as linear drives. The linear drives have one or a number of electric motors, wherein a speed-reducing gear having at least one gear step is connected downstream of each motor. A further gear, for example, in the form of a threaded spindle drive, can be connected downstream from the speed-reducing gear, which generates a linear movement of the output element from the rotational movement of the motor. The last gear element or a further element connected thereto forms an output element. The output element of the respective electromotive adjustment drive is connected to the respective furniture component (back part 5, leg part 6) or alternatively to a component connected to the base frame 2, so that during operation of the electric motor of the respective adjustment drive 7, 8, the movable furniture components are adjusted in relation to one another.

The electromotive adjustment drives 7, 8 are connected to a control unit 9. This connection can be embodied, for example, as a pluggable cable connection, which is not shown in greater detail here. The control unit 9 has an electrical supply unit, which provides the electrical power, for example, from the network, for the electromotive adjustment drives 7, 8. For this purpose, the control unit 9 is connectable in this example via a network cable (not shown) to a network plug having a network connection. The network plug conducts the input-side network voltage via the network cable to the electrical supply unit of the control unit 9, which outputs a low voltage in the form of a DC voltage on the secondary side and relays it to a motor controller.

Alternatively thereto, a network-dependent voltage supply (also not shown in greater detail) having network input and having secondary-side low voltage output, which supplies the low voltage in the form of a DC voltage via a line, is connected upstream of the control unit 9.

Furthermore, an operating unit 20 is associated with the item of furniture 1, using the operating elements 21 of which the electromechanical adjustment drives 7, 8 are controllable via the control unit 9. Upon actuation of an operating element 21, a control signal for activating the respective electromechanical adjustment drive 7, 8 is transmitted via a transmission link in a wireless or wired manner to the control unit 9.

The control unit 9 has switch elements, which convert the control signals of the transmission link into switch signals for switching the respective adjustment drive 7, 8. The switch elements can be, for example, relay switches and/or semiconductor switches. The manually actuable operating elements 21 of the operating unit 20 generate control signals, which are converted by the receiver of the control unit 9 into control currents for the switch elements. In a wired operating unit 20, the operating elements 21 switch the control current of the relay switches or the semiconductor switches, respectively. In both cases, the power switches of the relay switches or the semiconductor switches switch the high motor current of the respective electromotive adjustment drive 7, 8.

To prevent pinching of a body part during movement of the movable furniture parts 5, 6, the illustrated item of functional furniture 1 is equipped according to the application with proximity and/or touch detectors, which prevent an actuation of the adjustment units 7, 8 via the control unit 9 when a proximity to a sensor or a touch of the sensor is detected. This will be explained in greater detail hereafter in conjunction with FIG. 2.

Figure 2:
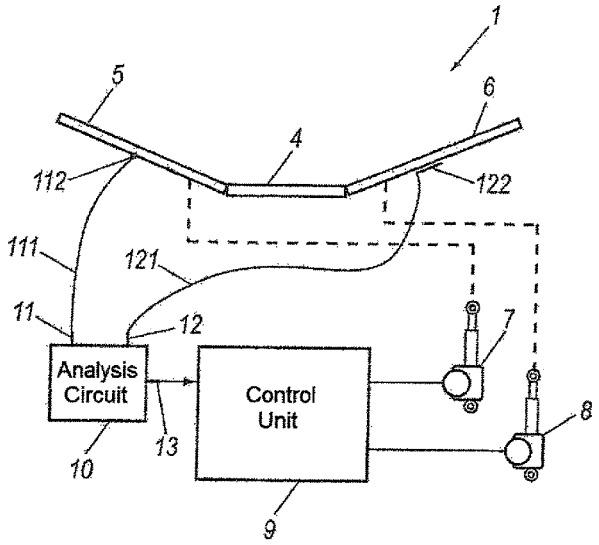
FIG. 2 shows a block diagram of components of the furniture arrangement.

FIG. 2 shows the system of FIG. 1 in a schematic block diagram. Identical reference signs identify identical or identically acting elements in this figure as in FIG. 1.

As described in conjunction with FIG. 1, the furniture fitting has the two movable furniture parts, the back part 5 and the leg part 6, which are movable in relation to a fixed base part 4. The movement is achieved via the two electromotive adjustment drives 7, 8, which act on the back part 5 or the leg part 6, respectively. The mechanical coupling of the adjustment drives 7, 8 to the back or leg part 5, 6, respectively, is only symbolized in FIG. 2 by a dashed line. The adjustment drives 7, 8 are activated and supplied with power by the control unit 9. A power supply of the control unit 9, for example, via an integrated or external power supply unit, is not shown in FIG. 2.

To prevent a body part from being pinched during movement of one of the movable furniture parts 5, 6, for example, between the movable furniture part 5, 6 and a stationary part of the item of functional furniture 1, an analysis circuit 10 is provided, which detects a touch on one of the movable furniture parts 5, 6. The analysis circuit 10 is arranged externally from the control unit 9 in the illustrated example and is electrically connected thereto via an output 13 of the analysis circuit 10. In alternative embodiments, the analysis circuit 10 can be integrated into the housing of the control unit 9.

The analysis circuit 10 has two inputs 11, 12 in the example shown, which are coupled via sensor lines 111, 121 to the furniture parts 5, 6. Accordingly, two sensor groups are formed, which respectively comprise the sensor line 111 or 121 and the furniture part 5, 6. Together with the analysis circuit 10, two independent touch and/or proximity detectors are accordingly formed as the pinch protector.

A touch or proximity to the furniture parts 5, 6 is detected via the sensor lines 111, 121 by the analysis circuit 10. At an output 13 of the analysis circuit 10, a signal is generated, which causes the control unit 9 to stop at least one of the two adjustment drives 7, 8. It can be provided in this case that a touch of the furniture part 5 or proximity to the furniture part 5 detected via the sensor line 111 only stops the associated adjustment drive 7, while in contrast the detection of a touch of the furniture part 6 or proximity to the furniture part 6 via the sensor line 121 stops the associated adjustment drive 8. Preferably, however, any touch, independently of which sensor line 111, 121 or which of the inputs 11, 12 the analysis circuit 10 detects it, results in stopping of all possibly simultaneously actuated adjustment drives 7, 8.

In one refinement, it can additionally be provided that the adjustment drives 7, 8 are not only stopped, but rather that a moving adjustment drive 7, 8 is operated for a predefined short period of time after the stopping in the reverse movement direction, to again release a body part which has possibly already been pinched.

The detection of a touch of the sensors by the analysis circuit 10 is preferably performed in a capacitive manner. This capacitive touch or proximity detection can be set to be sufficiently sensitive that a direct galvanic touch of an input 11 or an exposed section of the control line 111, 121 is not necessary, but rather a touch or proximity to insulated sections of the sensor line 111 or the furniture parts 5, 6 coupled thereto or also sections of a functional fitting coupled thereto can already be detected. In this manner, a detection of a touch of a painted or plastic-coated region of the movable furniture parts 5, 6 is also enabled.

If moving elements to be monitored, for example, the furniture parts 5, 6 or other sections of functional fittings, are entirely manufactured from an insulating material, for example, wood or plastic, a conductive element can be applied. The conductive element can consist of a continuation of the sensor line 111, 121 itself. Alternatively, for example, metallized films can be glued onto the nonconductive material. Furthermore, it is possible to make an insulating material superficially conductive using a conductive lacquer, for example, based on a conductive polymer. Materials or yarns having woven-in metallic threads or fibers can also be used as conductive elements.

FIG. 2 shows two different types of the coupling of the sensor lines 111, 112 to the movable furniture parts 5, 6 by way of example. The sensor line 111 contacts the furniture part 5 directly in a conductive connection 112. If the furniture part 5 is a lacquered steel pipe, for example, the lacquer can be superficially removed at one point and the sensor line 111 can be attached at this point. Alternatively, for example, a self-tapping screw can be screwed into the metal pipe of the furniture part 5, via which the conductive connection 112 is produced.

In contrast, the sensor line 12 is coupled via a capacitive coupling 122 to the furniture part 6. For this purpose, the sensor line 121 has a planar electrode at its end, which is adhesively bonded by means of a self-adhesive layer to a lacquered region of the furniture part 6, for example. The capacitance change of the furniture part 6 due to proximity or touch by a body part is transmitted by this capacitive coupling 122 to the sensor line 121 and therefore the analysis circuit 10.

In the illustrated exemplary embodiment of FIG. 2, two inputs 11, 12 and two corresponding sensor lines 111, 121 are provided by way of example. It is apparent that this number is solely an example. More than the illustrated two sensor lines 111, 121 can also be provided, by which more than two groups of monitored movable furniture parts 5, 6 are defined on the item of functional furniture 1.

The design of the various detectors also enables a large functional fitting, for example, in the case of the illustrated bed as the item of functional furniture 1, to be reliably monitored, without it having to be ensured that furniture parts 5, 6 to be monitored are galvanically connected to one another, or that sufficient capacitive coupling of the furniture parts with one another is provided. The allocation of all of the movable furniture parts 5, 6 to be monitored in an item of functional furniture for a pinch protector into at least two groups, which are associated with various detectors, additionally prevents an undesired incorrect response due to interfering radiation, which could be coupled in more easily in the case of a sensor surface, which would otherwise be excessively large under certain circumstances.

The analysis circuit 10 can internally have a single detector circuit for the capacitance change, which is connected in series in rapid succession in a multiplexing method to the at least two inputs 11, 12 (sequential analysis). Due to this measure of classification into multiple groups and the sequential analysis using only one detector circuit, the cost-effective production and easy installation of a high-sensitivity pinch protector is possible with operational reliability at the same time.

Alternatively, the analysis circuit 10 can have a number of detector circuits for a capacitance change corresponding to the number of the inputs 11, which are coupled to one another at the output side via a corresponding logic circuit, for example, an "or" linkage, so that upon response of any one of the detector circuits, a corresponding output signal is output at the output 13. To be able to use the analysis circuit 10 universally for a plurality of functional fittings or items of furniture, a larger number of inputs 11, 12 can be provided, for example, four inputs 11, 12, which also offers a sufficient number of groups for larger functional fittings.

Upon the use of such an analysis circuit in items of furniture which only require two or three monitored groups, inputs 11, 12 which are not used can be made inactive by connection to a ground potential, for example. Alternatively, by parameterizing a multiplexer used on the input side or a logic used on the output side in the analysis circuit 10, individual inputs 11, 12 can be selectively made inactive.

The detector circuits for recognizing a capacitance change are preferably self-adjusting in this case, so that a slow capacitance change, which is induced, for example, by changing environmental conditions such as changing ambient humidity, does not result in incorrect triggering. The sensor lines 111, 121 are preferably conventional single-core lines without shielding, which are cost-effective and can be laid easily.

Instead of an analysis circuit 10 having multiple inputs 11, 12, of course, multiple analysis circuits can also be used with one input each. In particular if multiple control units are provided on an item of functional furniture, one analysis circuit can be associated with each control unit.

The invention claimed is:

1. An electromotive furniture drive for adjusting movable furniture parts of an item of functional furniture, said electromotive furniture drive comprising two adjustment drives including at least one electric motor, a control unit operably connected to the adjustment drives, and an analysis circuit configured for connection in an electrically conductive manner to a plurality of sensors attached to the item of functional furniture to thereby form at least two proximity and touch detectors associated with different ones of the movable furniture parts of the item of functional furniture, wherein a first sensor is configured as a first sensor line that directly contacts, a first movable furniture part in a conductive connection, and a second sensor is configured as a second sensor line with a planar electrode bonded to a second movable furniture part thereby forming a capacitive coupling to the second movable furniture part, wherein a capacitance change of the first movable furniture part due to proximity or touch to the first movable furniture part by a body part is transmitted by the first sensor line to the analysis circuit which detects the proximity or touch of the first movable furniture part by the body part and a capacitance change of the second movable furniture part due to proximity or touch to the second movable furniture part b a body part is transmitted by the second sensor line to the analysis circuit which detects the proximity or touch of the second movable furniture part by the body part and the analysis circuit generates a signal to stop at least one of the two the adjustment drives, wherein after stopping, at least one of the two adjustment drives is operated for a predefined period of time in a reverse movement direction to release a body part which may have been pinched, wherein the analysis circuit includes a plurality of inputs coupled to the sensors in one-to-one correspondence and a multiplexer configured to sequentially connect the inputs to a single detector circuit of the analysis circuit.

2. An item of functional furniture, comprising:

at least two groups of movable furniture parts; and an electromotive furniture drive for adjusting the movable furniture parts, said electromotive furniture drive comprising two adjustment drives including at least one electric motor, a control unit operably connected to the adjustment drives, and an analysis circuit configured for connection in an electrically conductive manner to a plurality of sensors attached to the item of functional furniture to thereby form at least two proximity and touch detectors associated with different ones of the movable furniture parts of the item of functional furniture, wherein a first sensor is configured as a first sensor line that directly contacts a first movable furniture part in a conductive connection, and a second sensor is configured as a second sensor line with a planar electrode bonded to a second movable furniture part thereby forming, a capacitive coupling to the second movable furniture part wherein a capacitance change of the first movable furniture part due to proximity or touch to the first movable furniture part by a body part is transmitted by the first sensor line to the analysis circuit which detects the proximity or touch of the first movable furniture part by the body part and a capacitance change of the second movable furniture part due to proximity or touch to the second movable furniture part by a body part is transmitted by the second sensor line to the analysis circuit which detects the proximity or touch of the second movable furniture part by the body part and the analysis circuit generates a signal to stop at least one of the two the adjustment drives, wherein after stopping, at least one of the two adjustment drives is operated for a predefined period of time in a reverse movement direction to release a body part which may have been pinched, wherein the analysis circuit includes a plurality of inputs coupled to the sensors in one-to-one correspondence and a multiplexer configured to sequentially connect the inputs to a single detector circuit of the analysis circuit.

3. The item of functional furniture of claim 2, wherein each of the at least two groups of movable furniture parts is associated with the functional fitting of the item of functional furniture.

4. An electromotive furniture drive for adjusting movable furniture parts of an item of functional furniture; said electromotive furniture drive comprising:

two adjustment drives including at least one electric motor for moving a furniture part of the item of functional furniture;

a control unit operably connected to the adjustment drives; and an analysis circuit operably connected to the control unit and having inputs for connection in an electrically conductive manner to a plurality of sensors attached to the item of functional furniture to thereby form at least two proximity and touch detectors associated with different ones of the movable furniture parts of the item of functional furniture, wherein a first sensor is configured as a first sensor line that directly contacts a first movable furniture part in a, conductive connection, and a second sensor is configured as a second sensor line with a planar electrode bonded to a second movable furniture part thereby forming a capacitive coupling to the second movable, furniture part, wherein a capacitance change of the first movable furniture part due to proximity or touch to the first movable furniture part by a body part is transmitted by the first sensor line to the analysis circuit which detects the proximity or touch of the first movable furniture part by the body part and a capacitance change of the second movable furniture part due to proximity or touch to the second movable furniture part by a body part is transmitted by the second sensor line to the analysis circuit which detects the proximity or touch of the second movable furniture part by the body part and the analysis circuit generates a signal to stop at least one of the two the adjustment drives, wherein after stopping, at least one of the two adjustment drives is operated for a predefined period of time in a reverse movement direction to release a body part which may have been pinched, wherein the analysis circuit includes a plurality of inputs coupled to the sensors in one correspondence and a multiplexer configured to sequentially connect the inputs to a single detector circuit of the analysis circuit.

* * * * *